US006912885B2

(12) United States Patent
Keener et al.

(10) Patent No.: US 6,912,885 B2
(45) Date of Patent: Jul. 5, 2005

(54) METHOD OF PREPARING ULTRA-FINE GRAIN METALLIC ARTICLES AND METALLIC ARTICLES PREPARED THEREBY

(75) Inventors: Steven G. Keener, Trabuco Canyon, CA (US); Max R. Runyan, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 211 days.

(21) Appl. No.: 10/331,672

(22) Filed: Dec. 30, 2002

(65) Prior Publication Data

US 2004/0123638 A1 Jul. 1, 2004

(51) Int. Cl.[7] ..... B21C 23/00
(52) U.S. Cl. ..... 72/262; 72/260; 72/467
(58) Field of Search ..... 72/253.1, 256, 72/257, 260, 262, 272, 467, 468

(56) References Cited

U.S. PATENT DOCUMENTS

| | | | | |
|---|---|---|---|---|
| 4,721,537 | A | 1/1988 | Ghosh | |
| 5,026,520 | A | 6/1991 | Bhowal et al. | |
| 5,167,480 | A | 12/1992 | Gilman et al. | |
| 5,400,633 | A | 3/1995 | Segal et al. | |
| 5,460,317 | A | 10/1995 | Thomas et al. | |
| 5,513,512 | A | 5/1996 | Segal | |
| 5,614,037 | A | 3/1997 | Keener | |
| 5,826,456 | A | 10/1998 | Kawazoe et al. | |
| 5,850,755 | A | 12/1998 | Segal | |
| 5,858,133 | A | 1/1999 | Keener | |
| 5,904,062 | A | 5/1999 | Semiatin et al. | |
| 5,922,472 | A | 7/1999 | Keener | |
| 6,197,129 | B1 | 3/2001 | Zhu et al. | |
| 6,213,379 | B1 | 4/2001 | Takeshita et al. | |
| 6,221,177 | B1 | 4/2001 | Keener | |
| 6,230,958 | B1 | 5/2001 | Coletta et al. | |
| 6,370,930 | B1 * | 4/2002 | Lee et al. | 72/262 |
| 6,399,215 | B1 | 6/2002 | Zhu et al. | |
| 6,403,230 | B1 | 6/2002 | Keener | |
| 6,571,593 | B1 * | 6/2003 | Chung et al. | 72/262 |

FOREIGN PATENT DOCUMENTS

| | | |
|---|---|---|
| JP | 2000 225412 | 8/2000 |
| JP | 2001 205309 A | 7/2001 |
| JP | 2001 321825 | 11/2001 |

OTHER PUBLICATIONS

Search Report, French Application No. 0315400, dated Dec. 10, 2004, 2 pages.

Gysler, A., G. Terlinde, and G. Lütjering, "Influence Of Grain Size On The Ductility of Age–Hardened Titanium Alloys." Titanium and Titanium Alloys, Scientific and Technological Aspects, 1982, pp. 1919–1931, vol. 3, Plenum Press, New York.

"Aluminum Project Fact Sheet." Office of Industrial Technologies Energy Efficienty and Renewable Energy U.S. Department of Energy, 2 pgs, available at www.oit.doc.gov/aluminum/factsheets/plasticdeformation.pdf.

"U.S. and Russian scientists develop process for making pure titanium medical implants." News and Public Affairs New Releases, May 2, 2002, 3 pgs, available at www.lanl.gov/worldview/news/releases/archive.

* cited by examiner

*Primary Examiner*—Ed Tolan
(74) *Attorney, Agent, or Firm*—Alston & Bird LLP

(57) ABSTRACT

An apparatus and method are provided for angularly extruding a workpiece through a die to form blanks and articles having refined grain structure. The die is also used to form the workpiece to a desired shape, such as a cylinder. The angular extrusion method can be used in place of some heat treatments, thereby lowering the cost and time for manufacturing articles. The method is compatible with materials with high strength-to-weight ratios such as aluminum, titanium, and alloys thereof. The blanks can be used to form articles having favorable mechanical properties such as strength, toughness, formability, and resistance to fatigue, corrosion, and thermal stresses.

10 Claims, 6 Drawing Sheets

METHOD OF PREPARING ULTRA-FINE GRAIN METALLIC ARTICLES AND METALLIC ARTICLES PREPARED THEREBY

BACKGROUND OF THE INVENTION

1) Field of the Invention

The present invention relates to the manufacture of articles such as fasteners and, more particularly, relates to an apparatus and method for reducing the grain size of materials through an angular extrusion process and forming the articles therefrom.

2) Description of Related Art

Articles such as fasteners, clips, brackets and the like that are used in the aerospace industry, where weight and strength are of critical concern, typically are subjected to repeated cycles of shear, compressive, and/or tensile stresses over the life of the articles. As a result, the articles must exhibit good mechanical strength and fatigue resistance and preferably not be unduly heavy. In addition, because the articles may be exposed to the ambient environment, including moisture and temperature fluctuations, the articles must have good corrosion resistance and resistance to thermal stresses.

To address the strength and weight requirements, some articles such as rivets are typically formed of materials having high strength-to-weight ratios, such as aluminum and aluminum alloys that are hardened by cold working or precipitation hardening. Advantageously, a number of high strength aluminum alloys are available that are lightweight, and also have relatively high fatigue and corrosion resistance. A variety of heat treatments can be performed to achieve the desired properties of the materials. For example, heat treatments for rivets, including quenching, solution treating/annealing, and precipitation-hardening aging are discussed in U.S. Pat. No. 6,403,230 to Keener. Such heat treatments can be performed during or after the manufacture of the rivets. Often, multiple heat treatments are performed during manufacture to offset cold working effects that result during the formation of the rivets. For example, heat treatments such as annealing can be used to increase the formability of the material during manufacture. Following the formation of the articles, the desired mechanical properties of the articles can be achieved by other heat treatments, such as precipitation hardening or aging. Unfortunately, the various heat treatments required during such a manufacturing process are time consuming and increase the cost of the finished articles. Additionally, if the heat treatments are conducted improperly, undesirable mechanical properties can result in the articles.

Thus, there exists a need for an improved apparatus and method for manufacturing articles having favorable mechanical properties such as strength, toughness, formability, and resistance to fatigue, corrosion, and thermal stresses. Preferably, the method should reduce the amount of heat treating that is required during manufacture. Additionally, the method should be cost effective and compatible with materials that have high strength-to-weight ratios.

SUMMARY OF THE INVENTION

The present invention provides apparatuses and methods for manufacturing blanks and articles using angular extrusion to refine the grain structure thereof and imparting favorable mechanical properties such as strength, toughness, formability, and resistance to fatigue, corrosion, and thermal stresses. The methods can be used to manufacture articles such as rivets cost-effectively from materials with high strength-to-weight ratios such as aluminum, titanium, and alloys thereof.

According to one embodiment, the present invention provides an apparatus for extruding a workpiece to form a structural member having a refined, or "ultra-fine," grain structure. The apparatus includes first and second rotatable rollers configured to form a nip therebetween. One or both of the rollers are rotated by an actuator to advance a workpiece through the nip and into a die. The die defines an extrusion passage with first and second portions. The first portion at least partially defines a first cross-sectional shape that corresponds in shape to the workpiece, and one or both of the portions define a second cross-sectional shape that is imparted to the workpiece to form the blank. For example, the first and second cross-sectional shapes of the die can be rectangular and circular, respectively, so that a rectangular workpiece is extruded to form a cylindrical blank. The second portion defines an extrusion angle relative to the first portion so that the workpiece is angularly extruded through the passage. The extrusion angle can be between about 45 and 135 degrees, for example, about 90 degrees. The cross-sectional area of the second portion of the passage can be about equal to the cross-sectional area of the first portion of the passage, each cross sectional area being measured in a plane normal to the direction of motion of the workpiece in the respective portion.

According to another embodiment, the present invention provides a method of manufacturing an article having a refined grain structure and articles formed thereby. The method includes extruding the workpiece through the first and second extrusion passage portions so that a grain size of at least a portion of the workpiece is refined and the workpiece is extruded to form a blank. A cross-sectional shape of the workpiece can also be changed, for example, from rectangular to circular. At least a portion of the blank is then formed into the article, such as by extruding the blank through a die or stamping the blank with a punch. For example, the blank can be used to form a rivet having a cylindrical shank with a head at one end and a second end adapted to be upset to form a second head. The blank or the article can also be heat treated.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and which are not necessarily drawn to scale, wherein.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
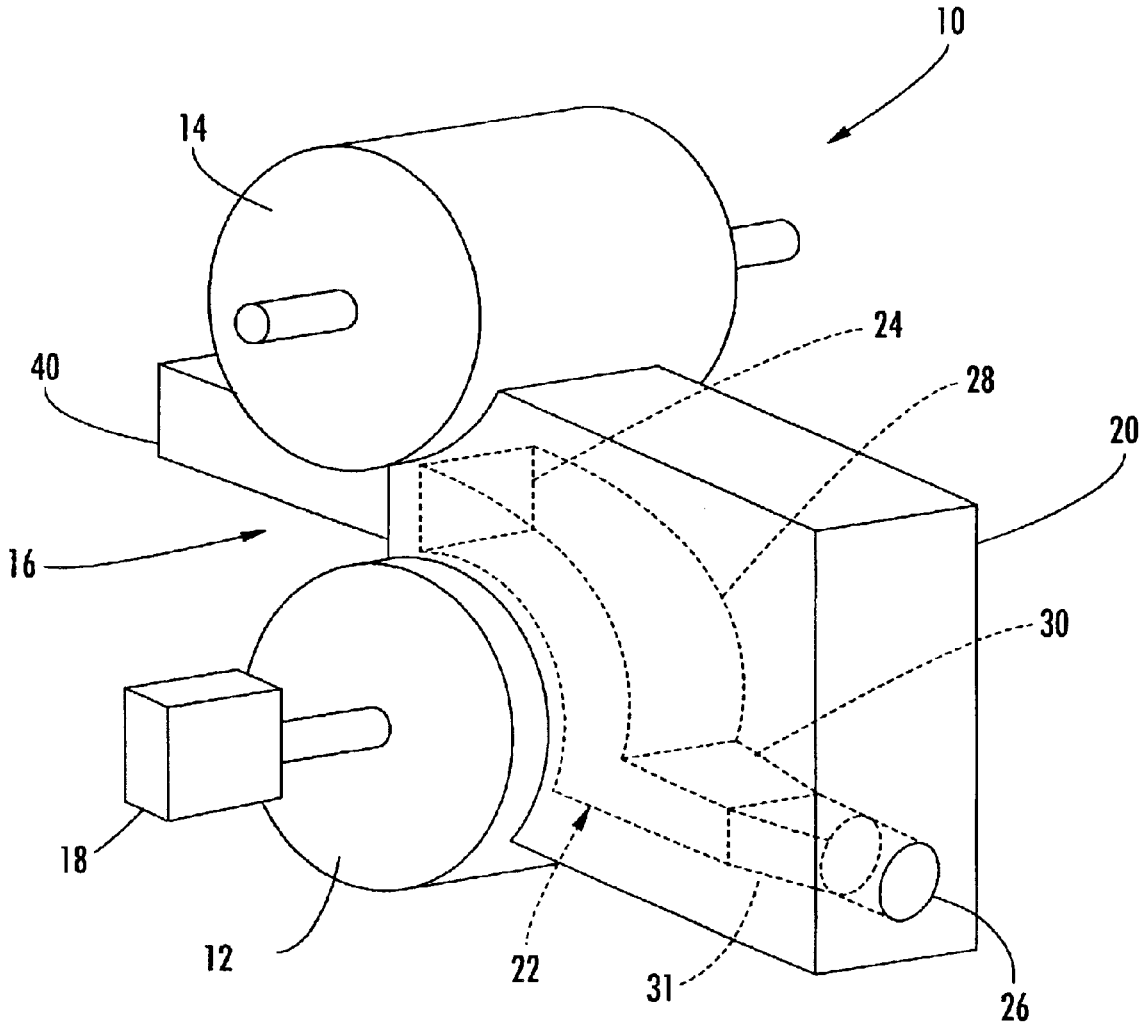
FIG. 1 is perspective view illustrating an extrusion apparatus according to one embodiment of the present invention.
Figure 2:
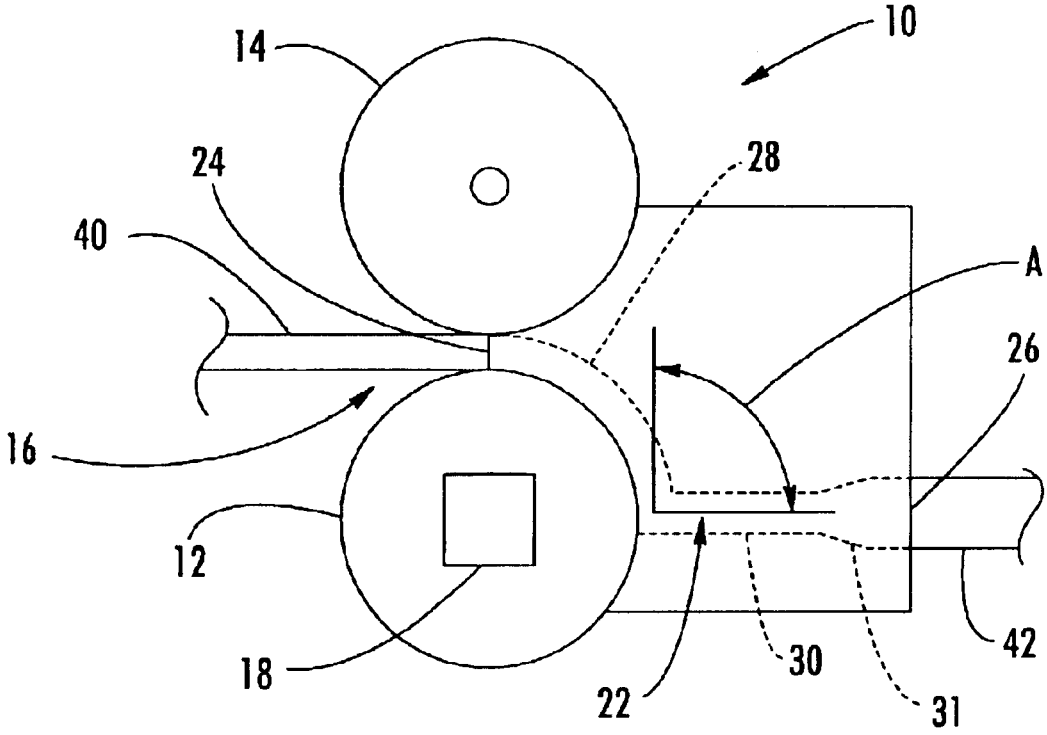
FIG. 2 is a sectional view in elevation illustrating the forming apparatus of FIG. 1.

Referring now to the drawings, and in particular to FIGS. 1 and 2, there is illustrated an extrusion apparatus 10 according to one embodiment of the present invention. The extrusion apparatus 10 includes two rollers 12, 14 configured to form a nip 16 therebetween for receiving a workpiece 40. The apparatus 10 also includes a die 20 defining an extrusion passage 22 through which the workpiece 40 is extruded. The rollers 12, 14 are configured to advance the workpiece 40 through the die 20 from an entry 24 to an exit 26 of the passage 22. The workpiece 40 is angularly extruded in the passage, as discussed below, to form a blank 42 of a desired shape that has a refined grain structure. The blank 42, shown in FIG. 3, can then be formed into one or more articles such as a rivet 50, as shown in FIG. 4. In other embodiments, other devices can be used to move the workpiece 40 through the die 20. For example, the apparatus 10 can include other arrangements of rollers or anvils for pushing the workpiece through the die 20, rollers configured to receive the blank 42 from the die 20 and pull or draw the blank 42 therefrom, and the like.

The rollers 12, 14 can be formed of metal such as tool steel or other hard and wear resistant metallic materials. The rollers 12, 14 can be arranged in a generally parallel configuration, and rotatably mounted on shafts. One or more actuators 18 can be connected to the rollers 12, 14 to rotate the rollers 12, 14 and move the workpiece 40 through the passage 22 of the die 20. The actuators 18 can be connected to both rollers 12, 14, or only of the rollers 12, 14, as shown in FIGS. 1 and 2. Each actuator 18 can be a hydraulic, pneumatic, or electrically powered device such as an electric motor. A control device (not shown) can be configured to monitor, adjust, and/or synchronize, the speed of the rollers 12, 14 according to a predetermined schedule, operating parameters, or commands provided by an operator.

The die 20, which can also be formed of tool steel or other hard and wear resistant metallic materials, can be shaped to at least partially receive the rollers 12, 14, as shown in FIG. 1 so that the workpiece 40 is directed into the entry 24 of the passage 22. The entry 24 can define a size and shape that correspond to the workpiece 40. For example, the workpiece 40 can be a piece of stock material such as rectangular aluminum or aluminum-alloy sheet or plate, and the entry 24 can be approximately the same size as the cross-sectional size of the workpiece 40. Alternatively, the workpiece 40 can define other shapes, such as a square or circular bar, sheet, foil, or the like. The workpiece 40 can be selected from a variety of materials such as aluminum, aluminum alloys, titanium, titanium alloys, and other metallic materials for which improved material properties can be achieved through angular extrusion.

The passage 22 defines first and second extrusion passage portions 28, 30, which define an extrusion angle A therebetween. The die 20 can be a single monolithic device, as shown in FIG. 1, or the die 20 can be an assembly comprised of multiple pieces, for example, each piece defining one of the passage portions 28, 30. Due to the extrusion angle A between the portions 28, 30 of the passage 22, the workpiece 40 is angularly extruded. The extrusion angle A is measured between the directions of motion of the workpiece 40 in the portions 28, 30 of the passage 22. For example, as shown in FIG. 2, the direction of motion of the workpiece 40 in the first portion 28 of the passage 22 immediately before entering the extrusion angle A is toward the bottom of the page, and the direction of motion of the workpiece 40 in the second portion 30 of the passage 22 immediately after emerging from the extrusion angle A is toward the right side of the page. Thus, the extrusion angle A of FIG. 2 is about 90 degrees. In any case, the extrusion angle A is between 0 and 180 degrees, and preferably the angle A is between about 45 and 135 degrees.

The cross-sectional areas of the first and second extrusion passage portions 28, 30 can be the same or different. According to one embodiment of the invention, the cross-sectional area of the second portion 30 of the passage 22, measured in a plane normal to the direction of motion of the workpiece 40 through the second portion 30, is about equal to the cross-sectional area of the first portion 28 of the passage 22, measured in a plane normal to the direction of motion of the workpiece 40 through the first portion 28 of the passage 22. Accordingly, the cross-sectional size of the workpiece 40 is not substantially increased or decreased due to the extrusion angle A, and the speed of the workpiece 40 through the passage 22 is about equal as the workpiece 40 enters the extrusion angle A from the first portion 28 of the passage 22 and emerges from the extrusion angle A into the second portion 30. Alternatively, the cross-sectional sizes of the first and second portions 28, 30 of the passage 22 can be dissimilar proximate to the extrusion angle A, for example, so that the cross-sectional size of the workpiece 40 is reduced in the extrusion angle A and moves at a faster speed as it emerges from the extrusion angle A or so that the cross-sectional size of the workpiece 40 is enlarged in the extrusion angle A and the workpiece 40 moves at a faster speed as it enters the extrusion angle A.

The shape of the portions 28, 30 proximate to the extrusion angle A can also be similar or dissimilar. According to one embodiment of the present invention shown in FIGS. 1 and 2, the workpiece 40 is rectangular as it enters the apparatus 10 and the entire length of the first portion 28 of the passage 22 as well as part of the second portion 30 of the passage 22 define a rectangular shape that is equal in size and aspect to the workpiece 40. Thus, the workpiece 40 enters and emerges from the extrusion angle with a shape and size that is substantially equal to the workpiece 40 at the entry 24. Thereafter, the workpiece 40 is extruded through the remaining part of the second portion 30 of the passage 22, which is circular in shape, and the workpiece 40 is formed into that circular shape therein. As shown in FIG. 1, a transition 31 between the rectangular and circular parts of the second portion 30 of the passage 22 can be gradual or smooth. It is appreciated that the workpiece 40 can alternatively be extruded from or to other shapes besides the rectangular and circular shapes shown in the figures. Additionally, the shape of the workpiece 40 can be changed at other locations in the passage 22. For example, the first portion 28 of the passage 22 can define a change in cross section so that the workpiece 40 is extruded therein to a shape that is the same or different than the final shape of the blank 42. Further, the entire first portion 28 of the passage 22 can define a first cross-sectional shape and the entire second portion 30 can define a second cross-sectional shape, the first and second cross-sectional shapes meeting at the extrusion angle A so that the workpiece 40 is angularly extruded through the extrusion angle A and simultaneously changed in shape.

The process of angular extrusion, sometimes referred to as "equal angle extrusion" in the art, mixes the material of the workpiece 40, thereby cold working the workpiece 40 and refining the grain structure by reducing the grain size of the material of the workpiece 40. While not intending to be bound by any particular theory of operation, it is believed that the material is plasticized as it passes through the shear plane at the angle A in the passage 22 and reconsolidates with a refined, or smaller, grain structure achieved through uniform cold-working and characterized by grains of reduced size that become homogenous throughout the workpiece 40. Upon cooling, the refined grain structure of the blank 42 imparts improved material characteristics such as improved strength, toughness, ductility, fatigue resistance, and corrosion resistance so that the material will resist the formation and propagation of cracks. It is believed that the refined grain structure formed according to the present invention is more formable or ductile than the unrefined grain structure or coarse-grained material of conventional materials that are used to form articles such as rivets since the former has a finer grain having a greater total grain boundary area to impede dislocation motion.

Thus, improved material properties can be achieved by the inventive process delineated herein, which can be used in addition to, or in lieu of, thermal or heat treatment processes used in the manufacture of articles. For example, metallic fasteners, such as the rivet 50 of FIG. 4, can be produced from the blank 42 formed according to the present invention. The rivets 50 can be formed from the blank 42 without the need for additional heat-treating steps subsequent to the extrusion through the apparatus 10, thus reducing the time and costs associated with manufacture and reducing the likelihood of improper heat treatment. Further, the improved material properties increase the usefulness of the finished articles. For example, the rivets 50 produced according to the present invention can have higher strength and be more fatigue, crack, and corrosion resistant than conventionally formed rivets.

Figure 3:
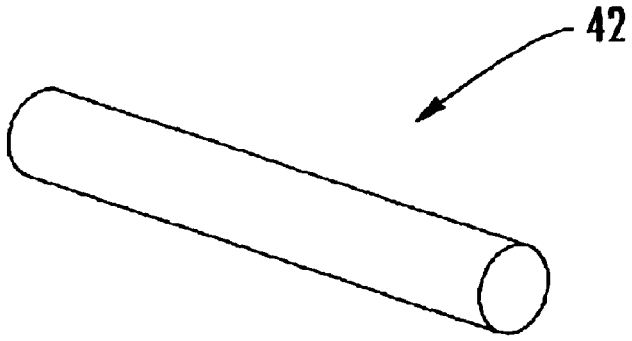
FIG. 3 is a perspective view of a blank formed according to one embodiment of the present invention.
Figure 4:
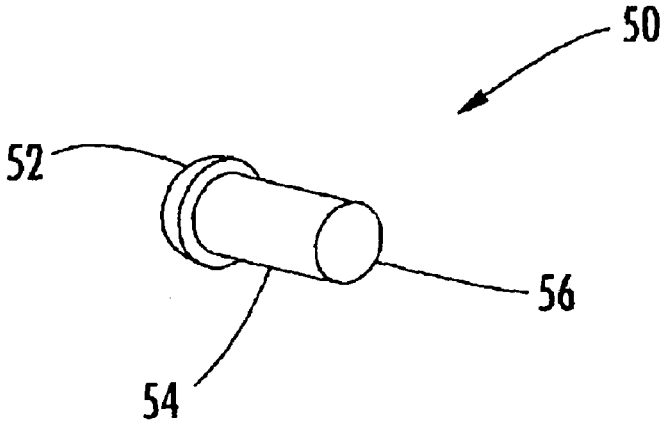
FIG. 4 is a perspective view illustrating a rivet formed according to one embodiment of the present invention.

The blank 42 of FIG. 3 can be used to form a variety of structural members or articles including, but not limited to, rivets 50, bolts, nuts, screws, clips, brackets, and the like. The articles can be formed by machining, stamping, punching, or otherwise cutting or forming the blank 42, and each blank 42 can be used to form a plurality of articles. The resulting articles can be used in a multitude of applications such as for joining members to form assemblies for aeronautical or aerospace vehicles and devices. Referring to FIG. 4, the rivet 50 formed from the blank 42 has a head 52 and a shank 54 extending therefrom. The shank 54 of each rivet 50 is structured to extend through an aperture defined by two or more members (not shown) that are to be joined by the rivet 50. The head 52 of the rivet 50 has a diameter that is larger than at least part of the aperture through which the shank 54 extends. An end 56 of the shank 54 opposite the head 52, which is structured to be inserted through the aperture, is structured to be upset to form a second head to thereby at least partially join the members. The end 56 can also define a cavity (not shown) to facilitate upsetting the end 56 to form the second head.

Figure 5:
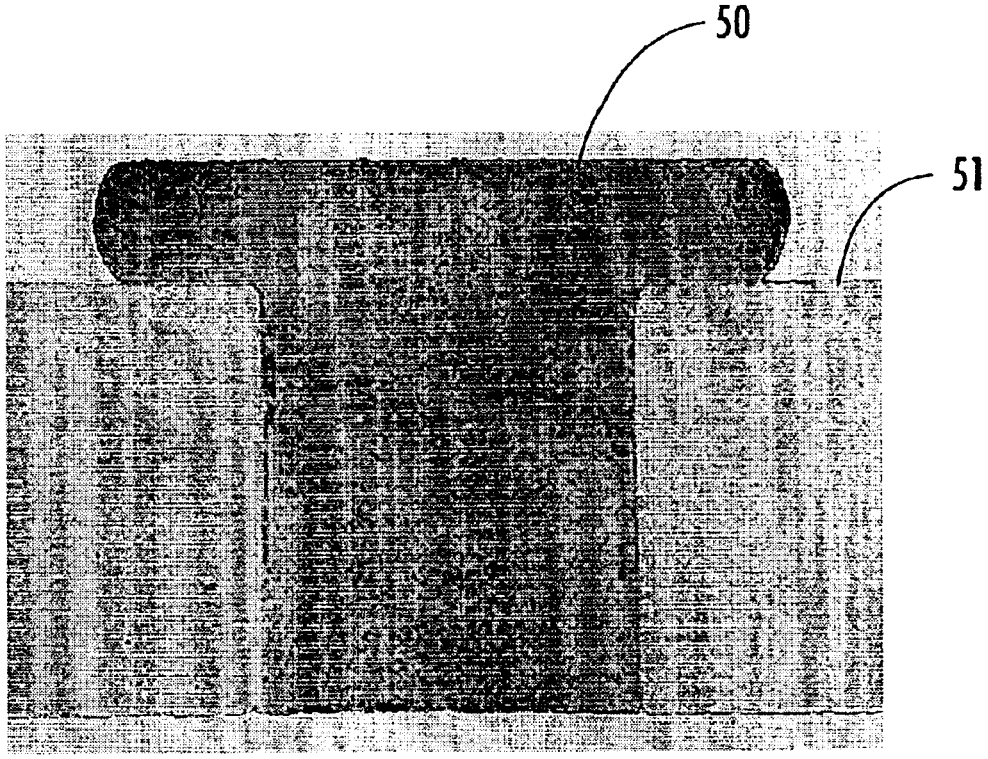
FIG. 5 is a digital image illustrating a sectional view of a rivet formed according to one embodiment of the present invention.
Figure 5A:
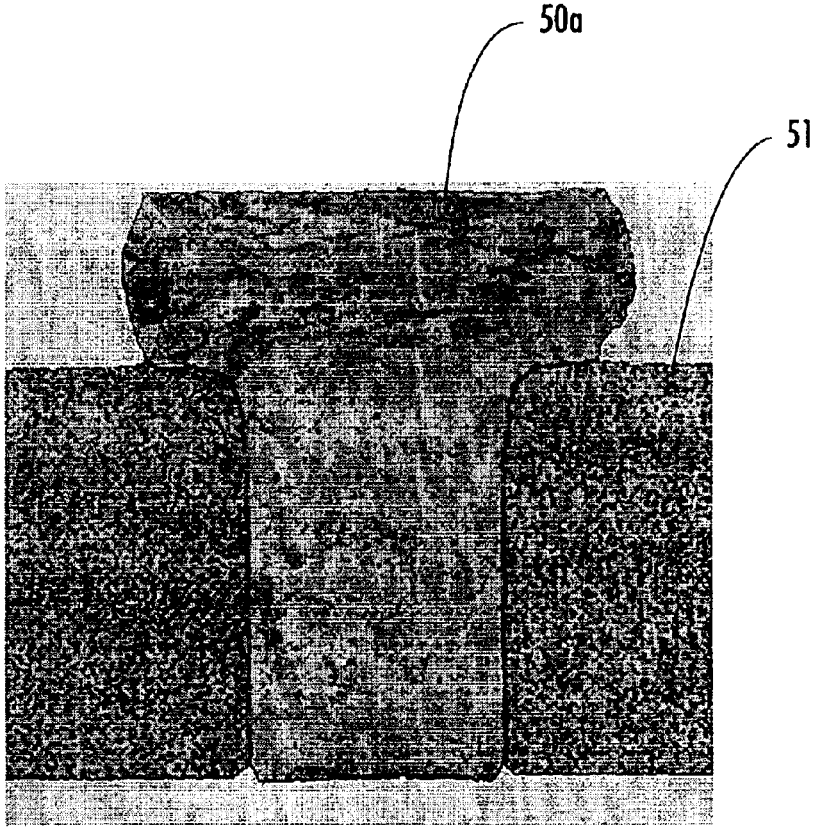
FIG. 5A. (PRIOR ART)
FIG. 5A is digital image illustrating a sectional view of a conventional rivet as is known in the art.

The rivets 50 are formed of a metal or metal alloy such that the rivets 50 have an ultra-fine grain structure, and preferably a refined grain structure with a grain size of less than about 0.0004 inches (approximately 10 microns), for example, a refined grain structure with a grain size ranging in order of magnitude from approximately 0.0001 to approximately 0.0003 inches (approximately 2.5 to 7.5 microns) and having equiaxed shape. FIG. 5 illustrates a rivet 50 formed according to the present invention that is disposed in a structural member 51. The rivet 50 is formed of aluminum and has an average grain size of between about 0.0001 and 0.0003 inches (approximately 2.5 to 7.5 microns). For purposes of illustration, there is shown in FIG. 5A a conventional aluminum rivet 50*a* with an average grain size of between about 0.002 and 0.003 inches (50 and 75 microns).

The blank 42 and/or the articles formed from the blank 42 can also be heat treated. According to one embodiment of the present invention, the rivets 50 are heat treated according to a predetermined heat treatment schedule by heating the rivets 50 to one or more heat treatment temperatures, maintaining those temperatures, and subsequently cooling. For example, rivets formed of 7050 aluminum alloy can be heated in a furnace from an ambient temperature to a first heat treatment temperature of about 250° F., held at that temperature for a duration of about 4–6 hours, further heated to a second heat treatment temperature of about 355° F., held at that temperature for a duration of about 8–12 hours, and thereafter cooled by ambient air to the ambient room temperature. Heat treatments are described in U.S. Pat. Nos. 6,403,230; 6,221,177; 5,922,472; 5,858,133; and 5,614,037 to Keener, each of which is assigned to the assignee of the present invention and the entirety of each of which is incorporated herein by reference.

Figure 6:
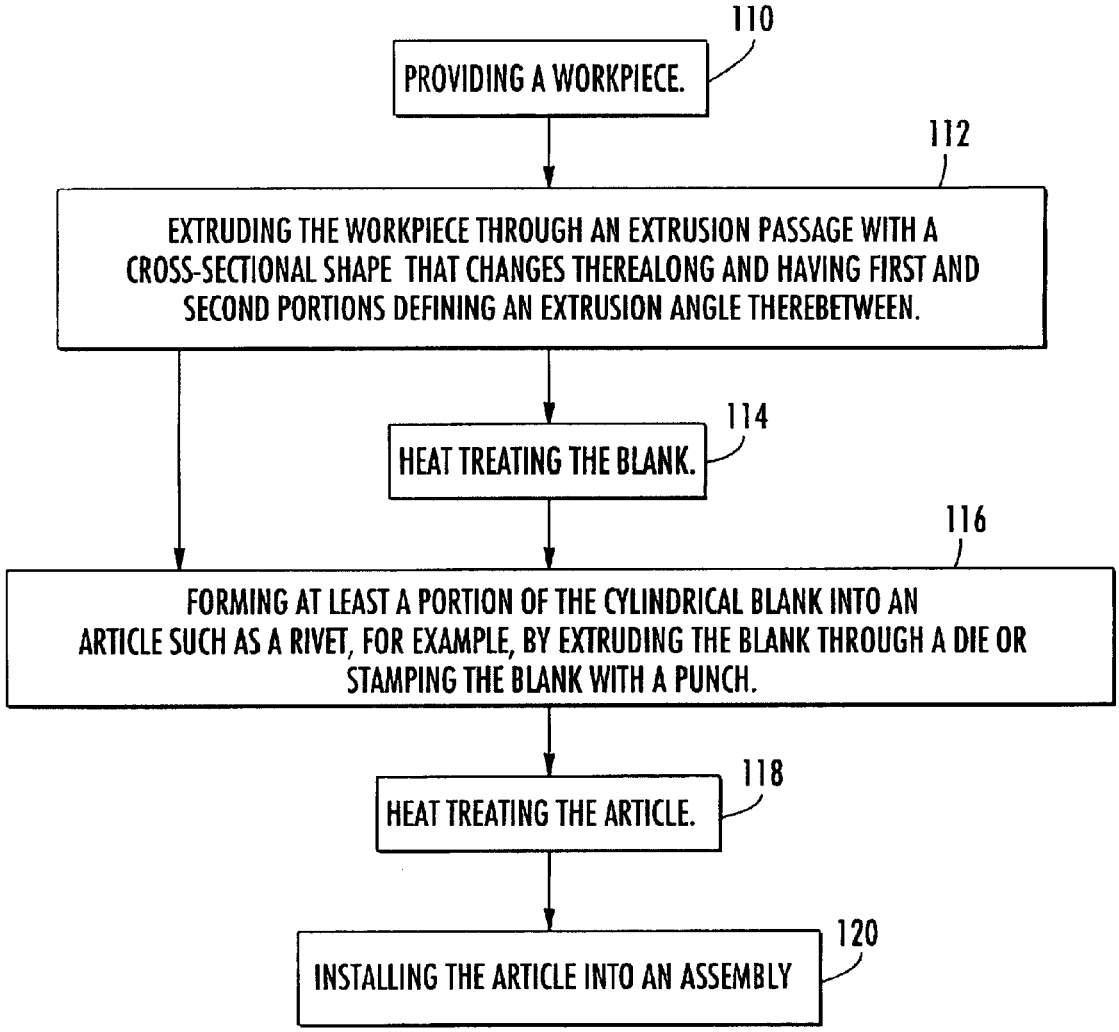
FIG. 6 is a flow chart illustrating the operations for manufacturing a structural member according to one embodiment of the present invention.

Referring now to FIG. 6, there are illustrated the operations for manufacturing a blank and articles having a refined grain structure according to one embodiment of the present invention. One or more of the operations illustrated in FIG. 6 can be omitted according to other embodiments of the invention. The method includes providing a workpiece such as a rectangular workpiece comprising aluminum, aluminum alloys, titanium, or titanium alloys. See block 110. The workpiece is extruded through an extrusion passage defining a cross-sectional shape that changes therealong and having first and second extrusion passage portions that define an extrusion angle therebetween. Thus, a grain size of at least a portion of the workpiece is refined and the workpiece is extruded to form a blank. For example, the workpiece can be extruded through a passage portion having a rectangular cross-sectional corresponding to the shape of the workpiece and a passage portion having a circular cross-sectional area that imparts a cylindrical shape to the workpiece to form the blank therefrom. See block 112. The blank can be heat treated. See block 114. At least a portion of the cylindrical blank is then formed into the article, such as a rivet. For example, the blank can be formed by extruding the blank through a die or stamping the blank with a punch. See block 116. The article can be heat treated. See block 118. The article can be installed into an assembly, for example, as a rivet that joins other components as described above in connection with FIG. 4. See block 120.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for extruding a workpiece to form a blank having a refined grain structure, the apparatus comprising:

first and second rollers configured to form a nip therebetween;

an actuator far rotating at least one of said first and second rollers and advancing the workpiece through the nip between said rollers; and a die configured to receive the workpiece from the nip, said die defining an extrusion passage having first and second portions, the first portion at least partially defining a first cross-sectional shape corresponding in shape to the workpiece, and at least one of the first and second portions defining a second cross-sectional shape different from the first cross-sectional shape for imparting the second cross-sectional shape to the workpiece to form the blank, wherein the second portion defines an extrusion angle relative to the first portion such that the workpiece is angularly extruded through the passage, the first portion of the extrusion passage defining a substantially rectangular cross-sectional shape corresponding to the shape of the workpiece and at least a part of the second portion of the extrusion passage defining a substantially circular cross-sectional shape that is imparted to the workpiece to form the blank.

2. An apparatus according to claim 1 wherein the extrusion angle is between about 45 and 135 degrees.

3. An apparatus according to claim 1 wherein the extrusion angle is about 90 degrees.

4. An apparatus according to claim 1 wherein an entry of the first portion of the passage defines a rectangular cross section corresponding to the workpiece.

5. An apparatus according to claim 1 wherein the cross-sectional area of the second portion of the passage measured in a plane normal to a direction of motion of the workpiece through the second portion is about equal to a cross-sectional area of the first portion of the passage measured in a plane normal to a direction of motion of the workpiece through the first portion of the passage.

6. A die for extruding a workpiece to form a blank having a refined grain structure, the die comprising:

an entry for receiving the workpiece; and an extrusion passage extending from the entry, the extrusion passage having first and second portions, the first portion at least partially defining a first cross-sectional shape corresponding in shape to the workpiece, and at least one of the first and second portions defining a second cross-sectional shape different from the first cross-sectional shape for imparting the second cross-sectional shape to the workpiece to form the blank, wherein the second portion defines an extrusion angle relative to the first portion such that the workpiece is angularly extruded through the passage, the first portion of the extrusion passage defining substantially rectangular cross-sectional shape corresponding to the shape of the workpiece and at least a pert of the second portion of the extrusion passage defining a substantially circular cross-sectional shape that is imparted to the workpiece to form the blank.

7. A die according to claim 6 wherein the extrusion angle between the first and second portions of the extrusion passage is between about 45 and 135 degrees.

8. A die according to claim 6 wherein the extrusion angle between the first and second portions of the extrusion passage is about 90 degrees.

9. A die according to claim 6 wherein an entry of the first portion of the passage defines a rectangular cross section corresponding to the workpiece.

10. A die according to claim 6 wherein the cross-sectional area of the second portion of the passage measured in a plane normal to a direction of motion of the workpiece through the second portion is about equal to a cross-sectional area of the first portion of the passage measured in a plane normal to a direction of motion of the workpiece through the first portion of the passage.

* * * * *